US007854077B1

(12) United States Patent
Jauregui

(10) Patent No.: US 7,854,077 B1
(45) Date of Patent: Dec. 21, 2010

(54) SHOE HAVING CONFIGURABLE MESSAGE BOARD

(76) Inventor: Mario I Jauregui, 12553 Adler Dr., Whittier, CA (US) 90606

( * ) Notice: Subject to any disclaimer, the term of this patent is extended or adjusted under 35 U.S.C. 154(b) by 728 days.

(21) Appl. No.: 11/753,437

(22) Filed: May 24, 2007

(51) Int. Cl.
*A43B 23/00* (2006.01)

(52) U.S. Cl. ..... 36/136

(58) Field of Classification Search ..... 36/136
See application file for complete search history.

(56) References Cited

U.S. PATENT DOCUMENTS

| | | | | |
|---|---|---|---|---|
| 512,468 | A | 1/1894 | Grundy | |
| 1,520,224 | A | 12/1924 | Bush | |
| 4,019,030 | A * | 4/1977 | Tamiz | 235/105 |
| 4,466,204 | A | 8/1984 | Wu | |
| 4,510,704 | A | 4/1985 | Johnson | |
| 4,611,416 | A | 9/1986 | Lin | |
| 4,891,797 | A | 1/1990 | Woodfalks | |
| 4,958,459 | A * | 9/1990 | Davidson | 40/636 |
| 5,331,753 | A * | 7/1994 | Rodibaugh | 36/136 |
| 5,457,900 | A * | 10/1995 | Roy et al. | 36/137 |
| 5,813,148 | A | 9/1998 | Guerra | |
| 7,117,614 | B2 * | 10/2006 | Tonkel | 36/100 |
| 7,325,337 | B2 * | 2/2008 | Cox et al. | 36/136 |
| 7,600,334 | B2 * | 10/2009 | Cox et al. | 36/136 |
| 2003/0101625 | A1 * | 6/2003 | Wu | 36/136 |

FOREIGN PATENT DOCUMENTS

| | | |
|---|---|---|
| IT | 1148544 | 12/1986 |
| JP | 6154010 | 6/1994 |
| WO | WO0230238 | 4/2002 |
| WO | WO0234079 | 5/2002 |

* cited by examiner

*Primary Examiner*—Marie Patterson
(74) *Attorney, Agent, or Firm*—Michael I Kroll

(57) ABSTRACT

A shoe having a configurable message board positioned therein. The configurable message board comprising apparatus for selecting a displayable character from a plurality of characters. The shoe having a plurality of windows with each having a manipulative element for selecting a displayable character from a plurality of characters with said characters including letters, numbers and graphic symbols. The display optionally providing illuminable elements including back lighting the user selected display.

15 Claims, 9 Drawing Sheets

SHOE HAVING CONFIGURABLE MESSAGE BOARD

BACKGROUND OF THE INVENTION

1. Field of the Invention

The present invention relates generally to foot wear and, more specifically, to one or more shoes having a configurable message board positioned within the sole comprising apparatus for selecting a displayable character from a plurality of characters. The sole has a plurality of windows for displaying a user selectable character from a plurality of characters with the characters including letters, numbers and graphic symbols. The shoe display optionally provides illuminable elements including back lighting for the user selected display.

2. Description of the Prior Art

There are other foot wear designed for similar purposes. Typical of these is U.S. Pat. No. 512,468 issued to Grundy on Jan. 9, 1894.

Another patent was issued to Bush on Dec. 23, 1924 as U.S. Pat. No. 1,520,224. Yet another U.S. Pat. No. 4,019,030 was issued to Tamiz on Apr. 19, 1977 and still yet another was issued on Aug. 21, 1984 to Wu as U.S. Pat. No. 4,466,204.

Another patent was issued to Johnson on Apr. 16, 1984 as U.S. Pat. No. 4,510,704. Yet another U.S. Pat. No. 4,611,416 was issued to Lin on Sep. 16, 1986. Another was issued to Woodfalks on Jan. 2, 1998 as U.S. Pat. No. 5,813,148 and still yet another was issued on Sep. 29, 1998 to Guerra as U.S. Pat. No. 5,813,148.

Another patent was issued to Johnson on Dec. 3, 1986 as IT Patent No. IT1148544. Yet another U.S. Patent No. JP6154010 was issued to Donarudo on Jun. 3, 1994. Another was issued to Song on Apr. 18, 2002 as U.S. Patent No. WO 02/30238 and still yet another was issued on May 2, 2002 to Song as U.S. Patent No. WO 02/34079.

U.S. Pat. No. 512,468

Inventor: Alfred Grundy

Issued: Jan. 9, 1894

A marking tag especially designed to be applied to hats, over shoes, and the like for the purpose of identification.

U.S. Pat. No. 1,520,224

Inventor: John A. Bush

Issued: Dec. 23, 1924

A shoe having an outer member, a lining provided with a sight opening, an identification member interposed between said lining and outer member and having its identifying elements exposed at said opening, the marginal portion of said identification member being stitched to said liner but not to outer member.

U.S. Pat. No. 4,019,030

Inventor: Farouq Tamiz

Issued: Apr. 19, 1977

A device for the recording of the number of steps taken by a pedestrian incorporates a digital incremental counter in the heel—or attached to the heel—of a shoe. An operating member projects below the heel and initiates actuation of the counter each time the heel is brought into contact with the ground. Reading the digital display at the beginning and at the end of a stage in a trip yields the number of steps taken and a rough measure of the distance traversed. A reset lever or button may also be provided to zero the display at the start of the measurement cycle.

U.S. Pat. No. 4,466,204

Inventor: Chyuan Jong Wu

Issued: Aug. 21, 1984

The present invention relates to a device for determining the number of steps and the distance walked. The present invention not only accumulates the number of steps walked, but also determines the distance which the walker has walked.

U.S. Pat. No. 4,510,704

Inventor: William Johnson

Issued: Apr. 16, 1985

A boot or shoe incorporating means (12) for detecting when a step is made, and means (5) for recording and displaying the total of the steps so recorded. The means (5) may be a mechanical counter and may be operated by a push button (11) mounted in the heel of the shoe. Alternatively the counter may be an electronic counter. In either case, the counter may be operated by an inertially operated mechanism. Where electronic counting means is used, the boot or shoe may incorporate a micro-processor and may be arranged to display, at will, such quantities as total number of steps made distance walked, means speed, etc., and may even be associated with pulse rate or blood pressure sensing means whereby these quantities may also be displayed.

U.S. Pat. No. 4,611,416

Inventor: Danny Lin

Issued: Sep. 16, 1986

An athletic shoe having a quarter and outer material covering portions thereof providing a window in the covering and an access opening into the space between the quarter and outer material.

U.S. Pat. No. 4,891,797

Inventor: Joselean Woodfalks

Issued: Jan. 2, 1990

A running shoe with an integral timer includes a shoe having an upper body portion and a lower sole portion divided into a toe portion and a rearward heel portion separated by a recessed arch portion. An electronic digital stop watch is embedded in the material utilized to form the recessed arch portion and a flexible cover is removably secured to cover a display and function control buttons provided on side wall portions of the central arch. A step counter may be mounted in the arch and includes an actuating switch embedded in the sole portion of the shoe for counting steps of an individual. Start/stop and reset buttons for the stop watch may be provided on heel and toe portions of the shoe, enabling an individual to actuate the stop watch by kicking the heel or toe of the shoe against an object.

U.S. Pat. No. 5,813,148

Inventor: Rafael Guerra

Issued: Sep. 29, 1998

Footwear with optical fiber illuminating display areas provides emphasis on illuminating certain features of the footwear, such as trademarks, logos, team sports, cartoon characters, and other artistic designs primarily for advertising, decoration and enhancing the visibility of the wearer. Footwear with optical fiber illuminating display areas includes: an optical fiber panel(s) made visible through an opening, window, or transparent material on the sole, upper, or tongue portions of the footwear; a light emitting device(s) which transmits light into the optical fiber panel(s); components and circuits for making the light emitting device(s) and the illuminating optical fiber display areas intermittently flash, alternate flash, alternate colors, sequence in motion, activate by pressure or motion switching, activate by manual switching, or any combination thereof; and batteries for supplying power to the light emitting device and the components and circuits aforementioned. A control module combines the light emitting device(s), components and circuits, and batteries into a housing which is positioned in the heel, sole, upper, or tongue portion of the footwear, depending on the embodiment employed. Such footwear embodiments include and are not limited to athletic shoes (e.g. Tennis, Basketball, aerobic, cross trainers, walking, jogging, running), casual and formal dress shoes, roller skates, Ice skates, and Ski boots.

Italy Patent Number IT1148544

Inventor: William Johnson

Issued: Dec. 3, 1986

The pedometer is mounted in a cavity (3a) of a heel (3) of a shoe. Exertion of the walker's weight upon the head (12) of a push button (11) advances a ratchet wheel (6) through a pawl (15) projecting from the stem (13) of the push button. A mechanical counter (5) is advanced by the wheel and the dial or drum (7) of the counter displays the count through aligned transparent plastics windows (8,9). A microswitch may be used instead of the push button, connected with a battery housed in the heel cavity and signaling to an integrated circuit counter. The display is registered as an LED or LCD digital display. Alternatively, a piezoelectric transducer may be used to sense steps and to signal to a microprocessor chip including a quartz crystal oscillator to provide clock pulses. The display can be set to indicate total steps taken, a distance traveled or speed and duration of walk.

Japan Patent Number JP6154010

Inventor: Dell Donarudo

Issued: Jun. 3, 1994

PURPOSE: To easily indicate the name of a user or the name of the group to which the user belongs at a low cost by attaching a figure indication panel with an opening for figure indication to the quarter of a shoe formed by gluing instep, quarter, tongue and heel to a sole. CONSTITUTION: A shoe is formed by sewing or gluing instep 11, quarters 14, tongue 24 and heel 26 onto sole 13. Figure indication panel 16 is fastened at its outer edges 16a to 16d onto the outer face of at least one of quarters 14 and has opening 15 to which a figure indication plate is inserted. Defined by opening 15 is figure indication region 12 wherein a figure indication plate showing the name of a user or the name of the group to which the user belongs is inserted. Therefore, the name and the number of a user or the group to which the user belongs can be indicated easily on a shoe without the help from a maker.

International Patent Application Number WO 02/30238

Inventor: Moon Ho Sing

Issued: Apr. 18, 2002

The present invention discloses a walking counter device to be installed in the shoe comprises a weight detection sensor that is installed at the sole and/or heel of shoe to detect the weight which is imposed to the shoe; a selection switch to select the function of the said walking counter device; an acceleration detection sensor that is installed at a certain place of the shoe to detect the acceleration signal generated in accordance with the acceleration state, which is being generated by movement of the shoe; a controller that is connected with the said sensors, and controls the walking indication signal obtained by calculating the signals inputted from each sensor, when an acceleration signal generated by movement of the shoe at the state of becoming the weight over the set up weight is detected; and a display member that shows a walking information which is received from the controller. The walking counter device according to the present invention has the advantages that it is not necessary to carry the pedometer on the walker, but also it is possible to provide the exact information according to the walk done.

International Patent Application Number WO 02/34079

Inventor: Moon Ho Sing

Issued: May 2, 2002

The present invention discloses a shoe being installed with the pedometer, which comprises of the heel having the concavity on the upper part thereof to insert the lower part of pedometer, the sole having the reversed concavity under the sole to insert the upper part of the pedometer, and a guide hole to receive the push piece, a pedometer having display showing walking number and/or the consumed calories, counter switch and the guide groove for receiving safely the spring, and the inner sole to receive weight being imposed on the shoe, having a round shape groove of which position corresponds to the push piece and guide hole of the sole.

While these foot wear may be suitable for the purposes for which they were designed, they would not be as suitable for the purposes of the present invention, as hereinafter described.

The present invention provides one or more shoes having a configurable message board positioned therein. The configurable message board comprising apparatus for selecting a displayable character from a plurality of characters. The shoe having a plurality of windows with each having a manipulative element for selecting a displayable character from a plurality of characters with said characters including letters, numbers and graphic symbols. The display optionally providing illuminable elements including back lighting the user selected display.

SUMMARY OF THE PRESENT INVENTION

A primary object of the present invention is to provide one or more shoes having a configurable message board positioned therein.

Another object of the present invention is to provide shoes having configurable message board comprising apparatus for selecting a displayable character from a plurality of characters.

Yet another object of the present invention is to provide shoes having a plurality of windows with each having a manipulative element for selecting a displayable character from a plurality of characters with said characters including letters, numbers and graphic symbols.

Still yet another object of the present invention is to provide shoes that the configurable message board comprising apparatus for selecting a displayable character is selected manually by the user.

Another object of the present invention is to provide a display optionally providing illuminable elements including back lighting the user selected display.

Additional objects of the present invention will appear as the description proceeds.

The present invention overcomes the shortcomings of the prior art by providing one or more shoes having a configurable message board positioned therein. The configurable message board comprising apparatus for selecting a displayable character from a plurality of characters. The shoe having a plurality of windows with each having a manipulative element for selecting a displayable character from a plurality of characters with said characters including letters, numbers and graphic symbols. The display optionally providing illuminable elements including back lighting the user selected display.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
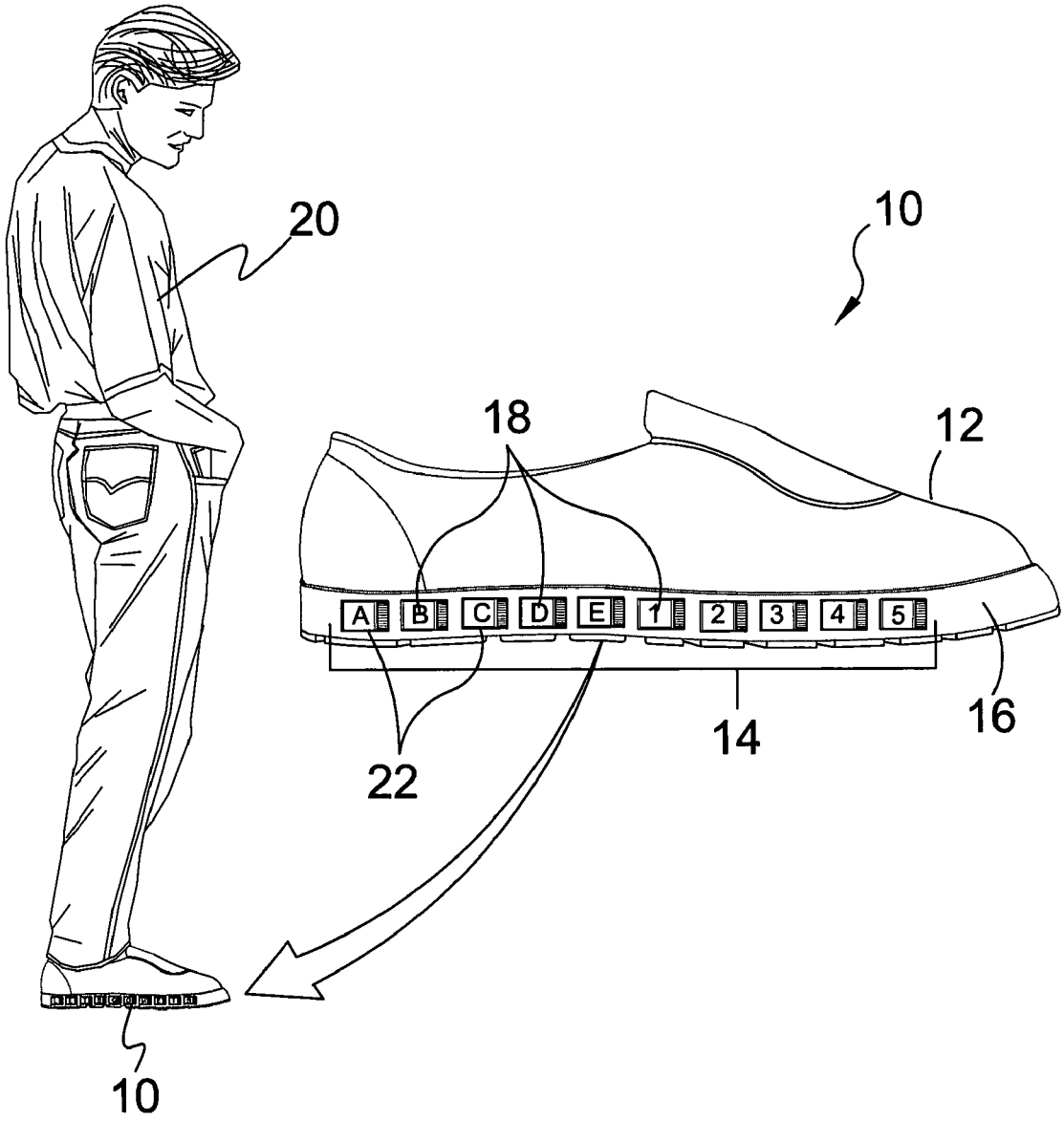
FIG. 1 is an illustrative view of the present invention in use.

Turning now descriptively to the drawings, in which similar reference characters denote similar elements throughout the several views, the figures illustrate the Shoe With Configurable Message Board of the present invention. With regard to the reference numerals used, the following numbering is used throughout the various drawing figures.

10 Shoe With Configurable Message Board of the present invention
12 shoe
14 configurable message board display
16 sole of 12
18 graphic/alpha/numeric indicia
20 user
21 dial wheel assembly
22 window of 14
24 dial wheel
26 character belt
28 first spool for 21
30 second spool for 21
32 drive belt
34 drive gear
36 illuminable element

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a shoe having a configurable message board display 14 positioned within the sole 16 comprising a plurality spooled apparatus for selecting a displayable graphic/alpha/numeric indicia 18 that are user 20 adjustable. The sole 16 has a plurality of windows 22 for displaying the indicia 18. The shoe display optionally provides illuminable elements including back lighting for the user 20 selected display.

Figure 2:
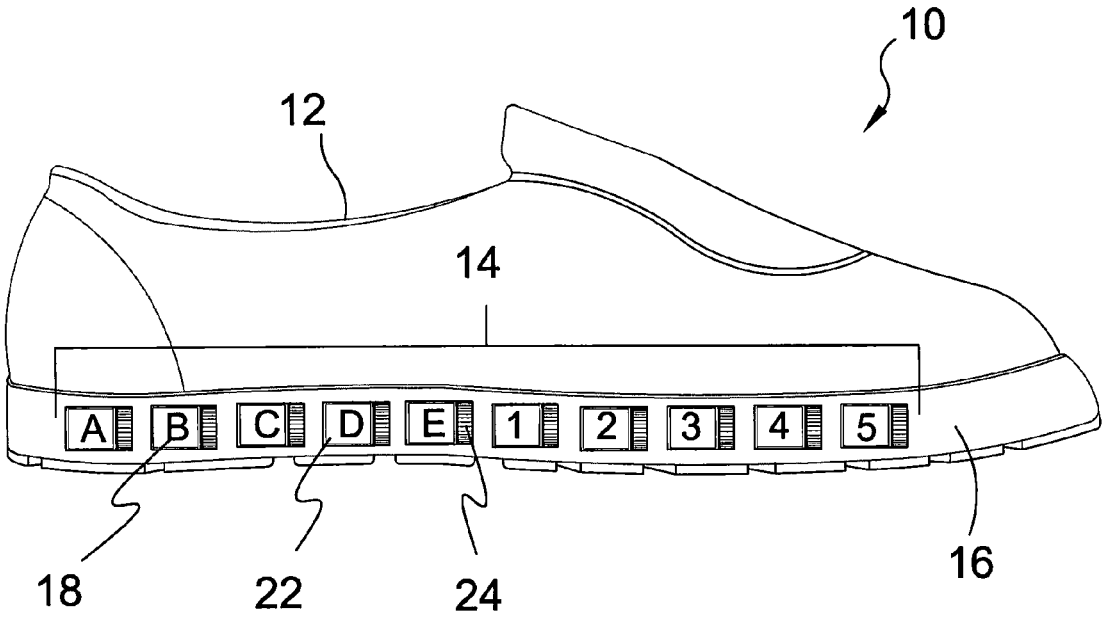
FIG. 2 is a side view of the present invention.

FIG. 2 is a side view of the present invention 10. Shown is a side view of the shoe 12 of the present invention 10 having a configurable message board 14 incorporated into the sole 16 thereof. The configurable message board 14 provides a dial wheel 24 for selecting a displayable indicia 18. Each shoe 12 has a plurality of windows 22 with each having a manipulative dial wheel 24 for selecting displayable indicia 18 from a plurality of characters with said characters including letters, numbers and graphic symbols.

Figure 3:
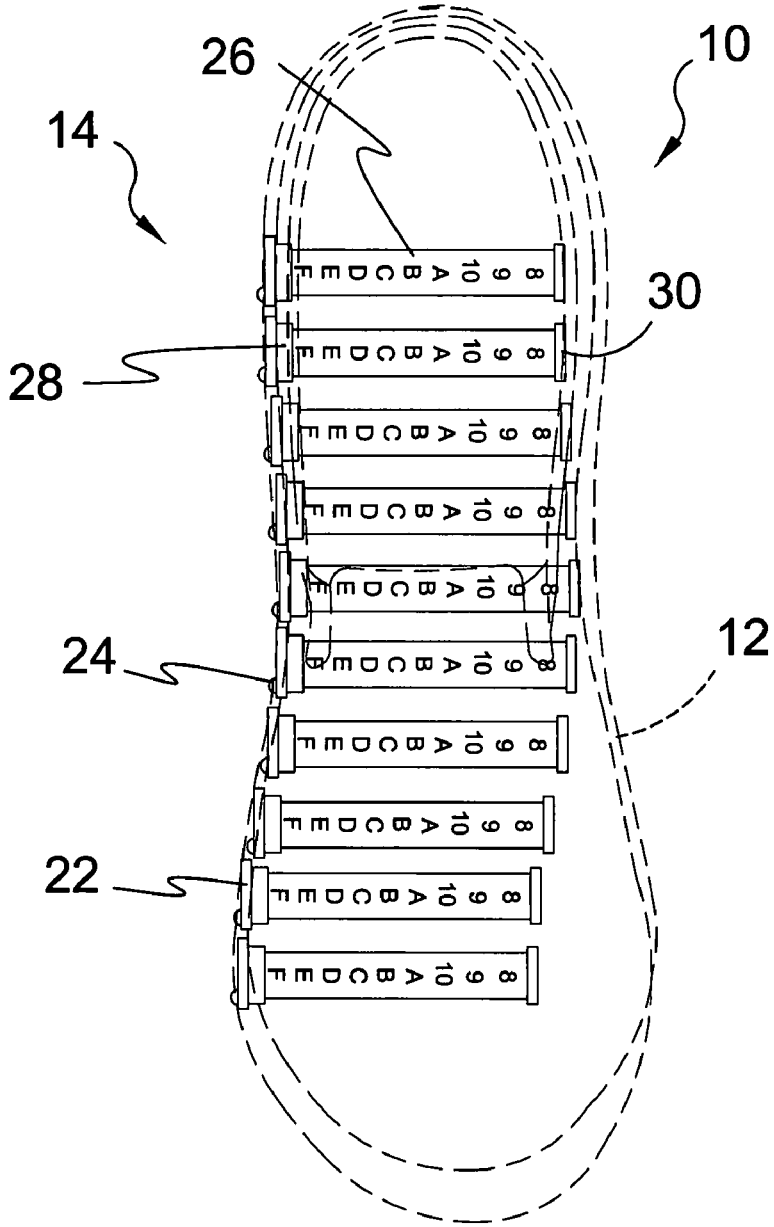
FIG. 3 is a top view of the present invention.

FIG. 3 is a top view of the present invention 10. Shown is a top view of the shoe 12 of the present invention 10 having a configurable message board 14 positioned therein. The configurable message board 14 provides a dial wheel 24 for selecting displayable indicia 18. Each shoe 12 has a plurality of windows 22 with each having a manipulative dial wheel 24 for selecting the desired indicia 18 from its respective character belt 26. Each character belt 12 spools from a first spool 28 associated with its dial wheel 24 to a second spool 30.

Figure 4:
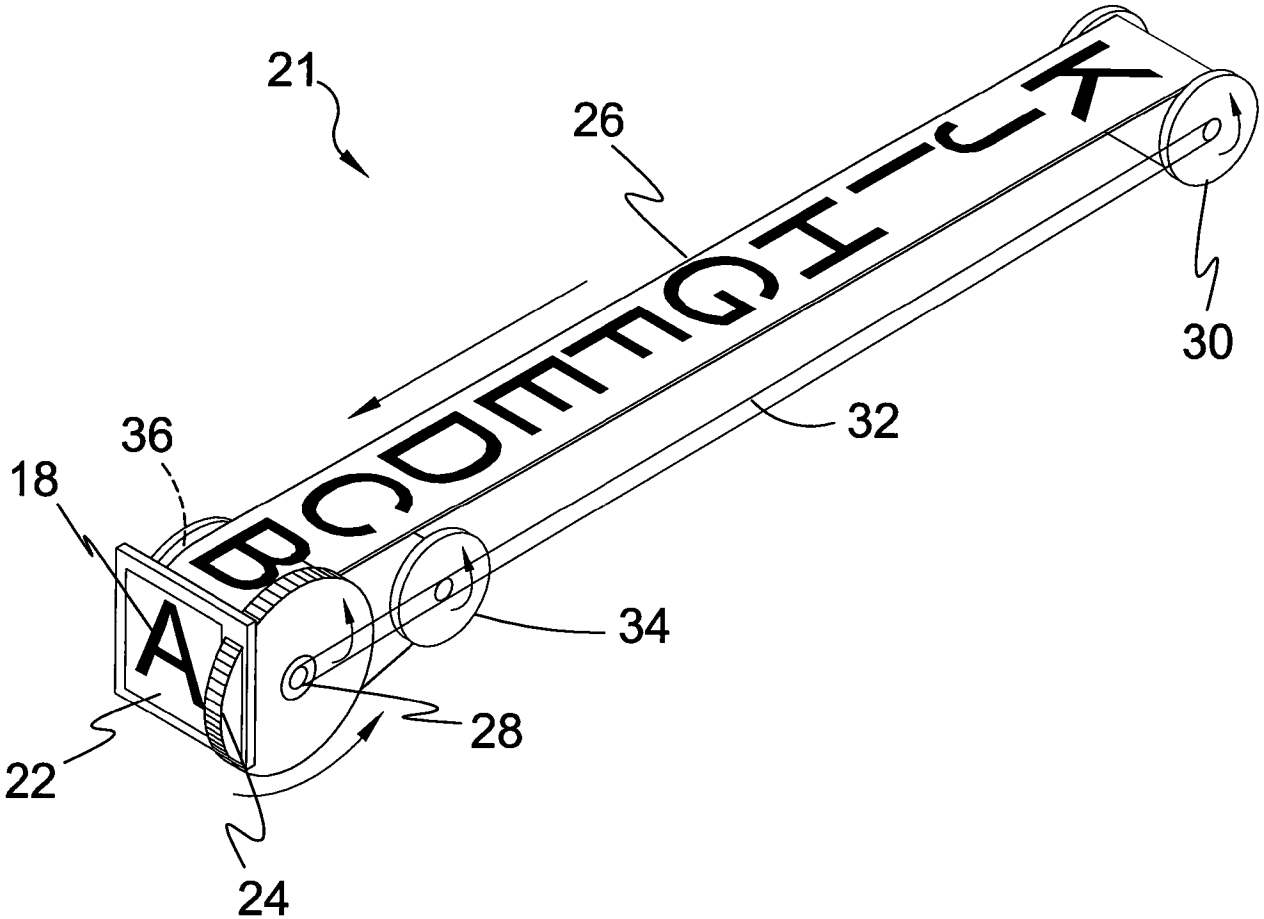
FIG. 4 is a perspective view of the dial wheel assembly of the present invention.

FIG. 4 is a perspective view of the dial wheel assembly 21 of the present invention. Shown is a character selection wheel assembly 21 of the present invention having a selection dial wheel 24 for selecting displayable indicia 18 from a plurality of characters. A drive gear 34 is in geared communication with the dial wheel 24 and its respective first spool 28 with a crossover drive belt 32 axially connected thereto on one end and axially connected to the second spool 30 at the other end thereby enabling the user to select the desired indicia 18 displayed in the window 22 by turning the dial wheel 24 and spooling the character belt 26 between the first spool 28 and the second spool 30 as needed. The shoe display optionally provides illuminable elements 36 disposed within the first spools 28 to include back lighting for the user selected display.

Figure 5:
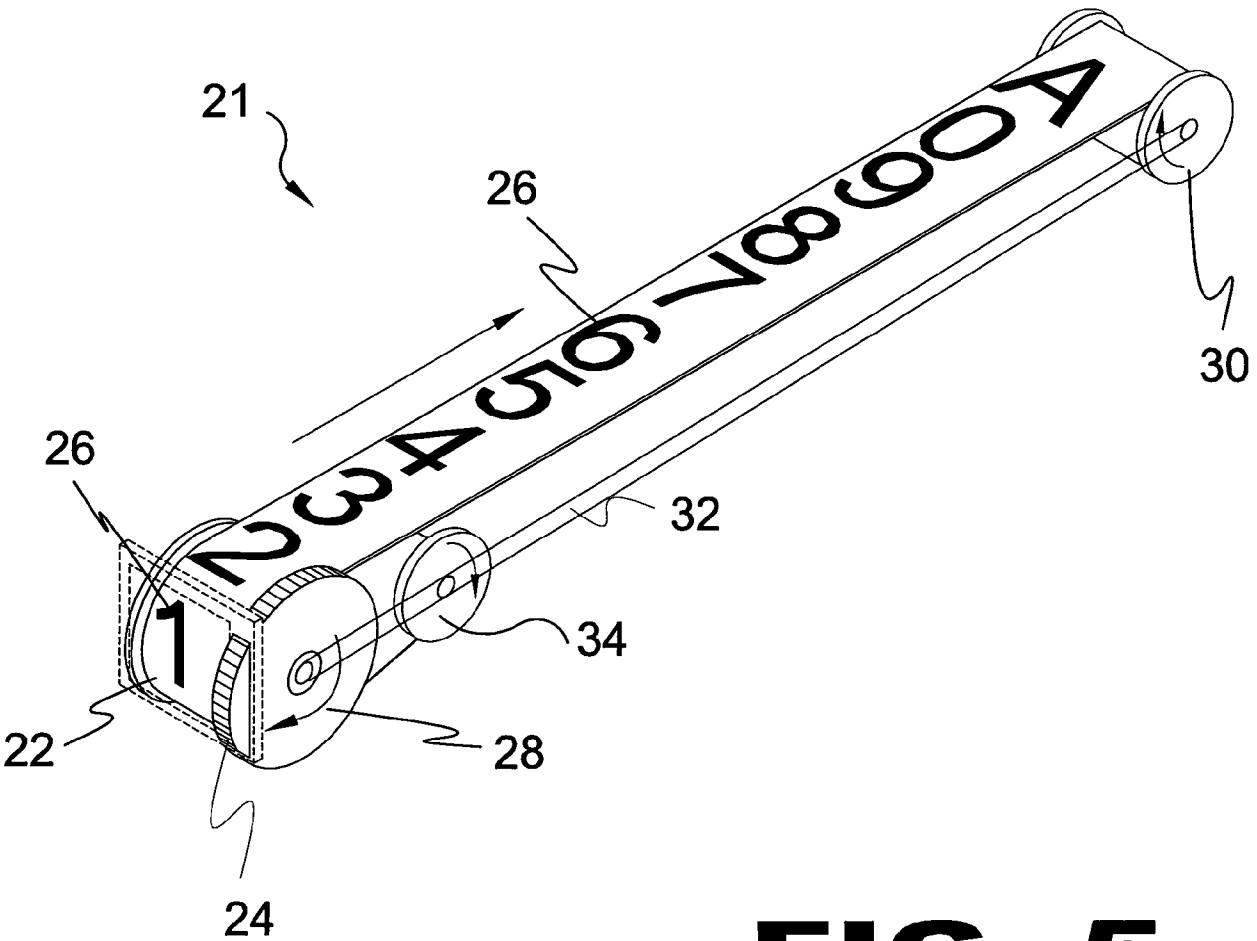
FIG. 5 is an assembly view of the character selection assembly of the present invention.

FIG. 5 is an assembly view of the character selection assembly of the present invention dial wheel assembly 21 of the present invention. Shown is a character selection wheel assembly 21 of the present invention having a selection dial wheel 24 for selecting displayable indicia 18 from a plurality of characters. A drive gear 34 is in geared communication with the dial wheel 24 and its respective first spool 28 with a crossover drive belt 32 axially connected thereto on one end and axially connected to the second spool 30 at the other end thereby enabling the user to select the desired indicia 18 displayed in the window 22 by turning the dial wheel 24 and spooling the character belt 26 between the first spool 28 and the second spool 30 as needed.

Figure 6:
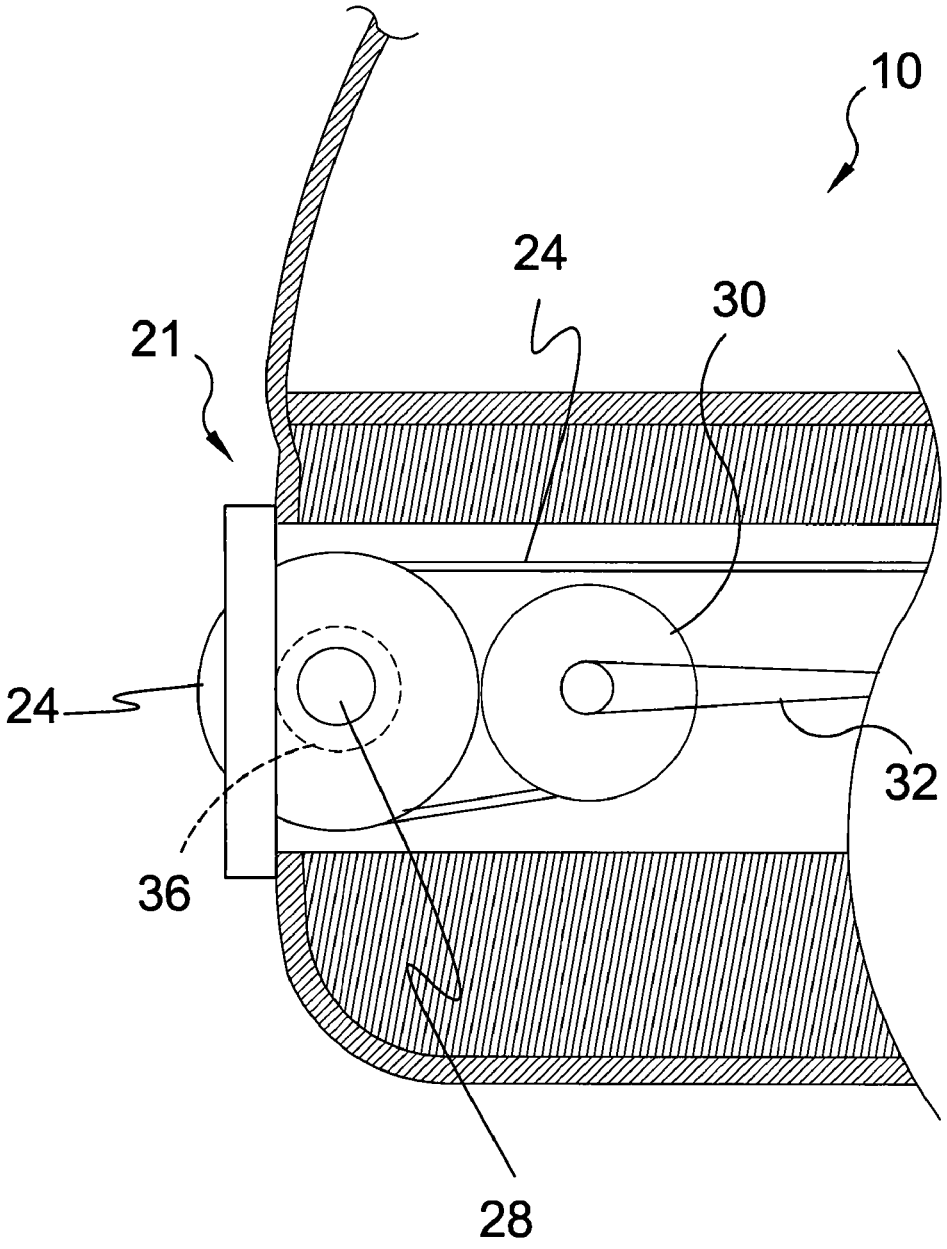
FIG. 6 is a sectional view of the present invention.

FIG. 6 is a sectional view of the dial wheel assembly 21 of the present invention 10 demonstrating the relationship of the character belt drive 26 components. Rotation of the dial wheel 24 turns the first spool 28 and its related drive gear 34 and the drive belt 32 which is axially associated therewith. The crossover configuration of the drive belt 32 permits reciprocating spooling of the character belt 26 between the two spools according to the manipulation of the dial wheel 24 by the user.

Figure 7:
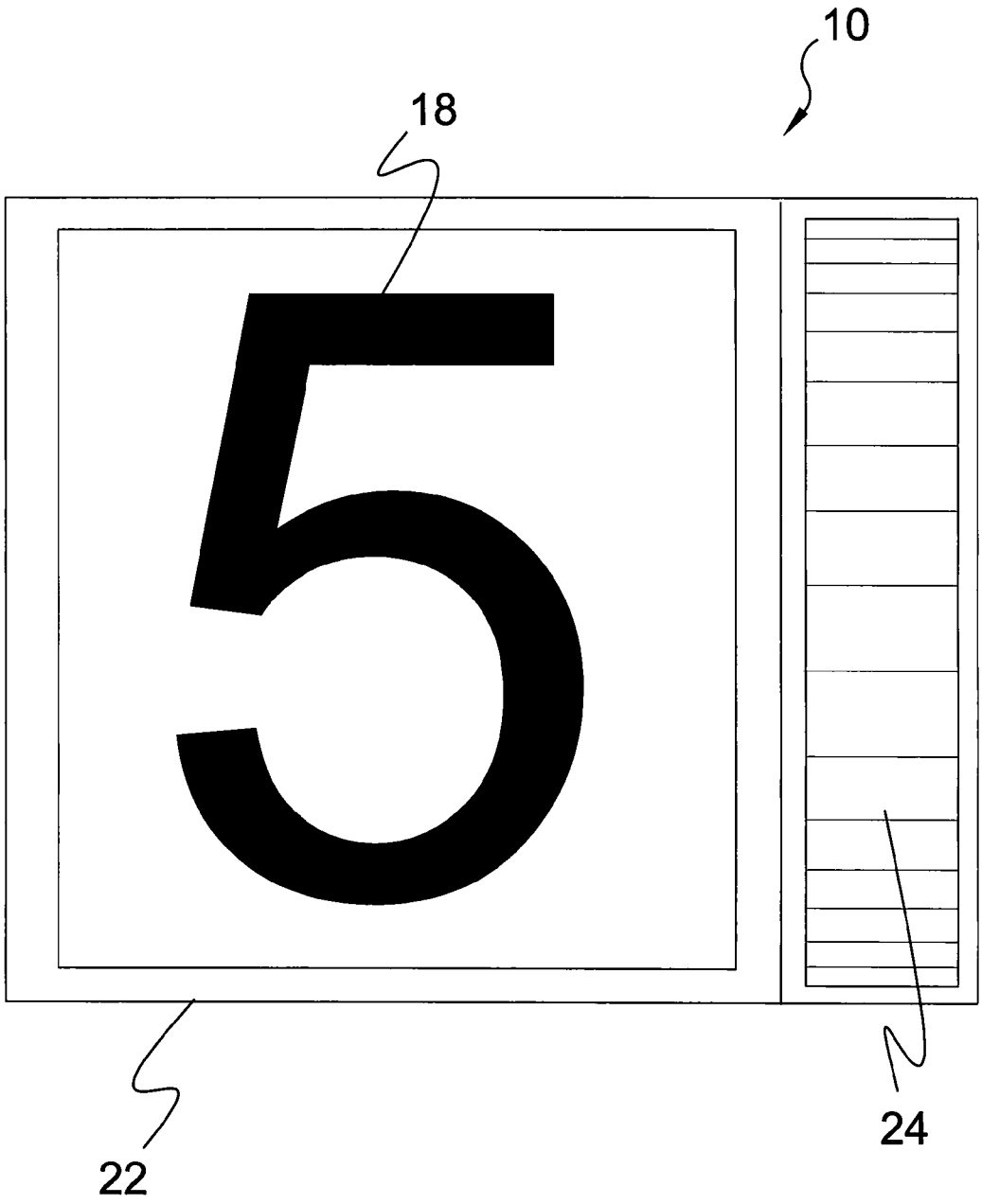
FIG. 7 is a frontal view of the display window of the present invention.

FIG. 7 is a frontal view of the display window 22 of the present invention 10. Shown is a frontal view of the display window 22 having a window 22 with a manipulative selection dial wheel 24 for selecting displayable indicia 18 selected from a plurality of characters with said characters including letters, numbers and graphic symbols. The display optionally providing illuminable elements including back lighting the user selected display.

Figure 8:
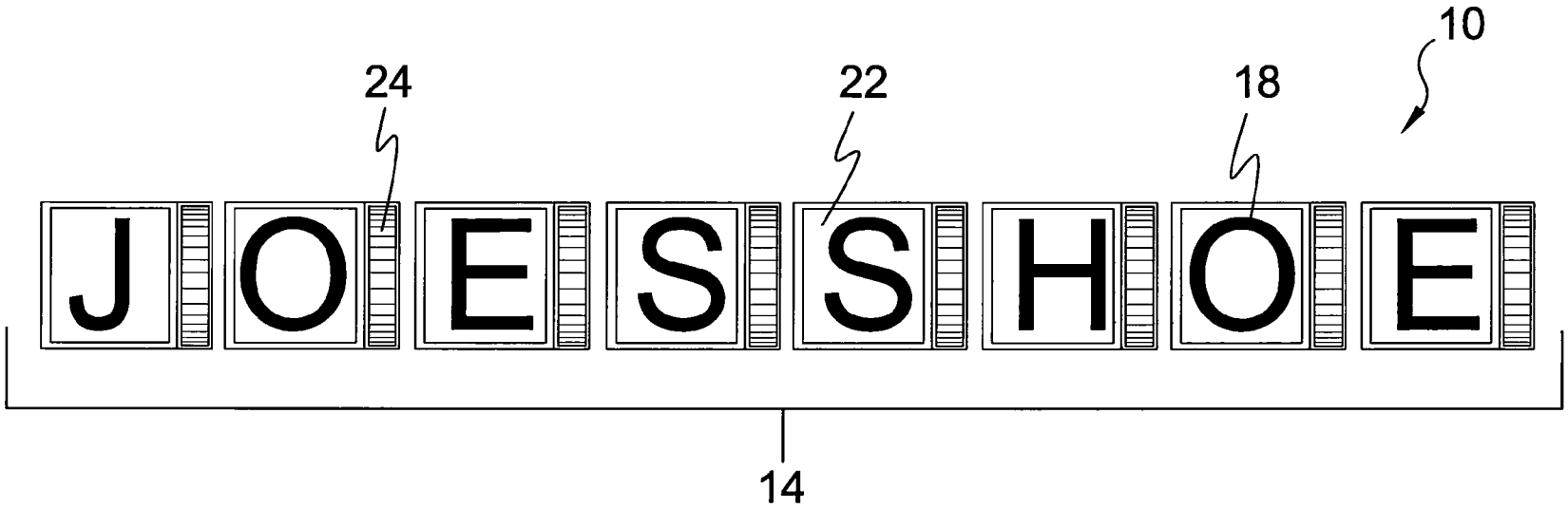
FIG. 8 is a frontal view of the character display board of the present invention.

FIG. 8 is a frontal view of the character display board 14 of the present invention 10. Shown is frontal view of the configurable message display board 14 having a plurality of windows 22 with a manipulative selection dial wheel 24 for selecting displayable indicia 18 selected from a plurality of characters with said characters including letters, numbers and graphic symbols. The display optionally providing illuminable elements including back lighting the user selected display.

Figure 9:
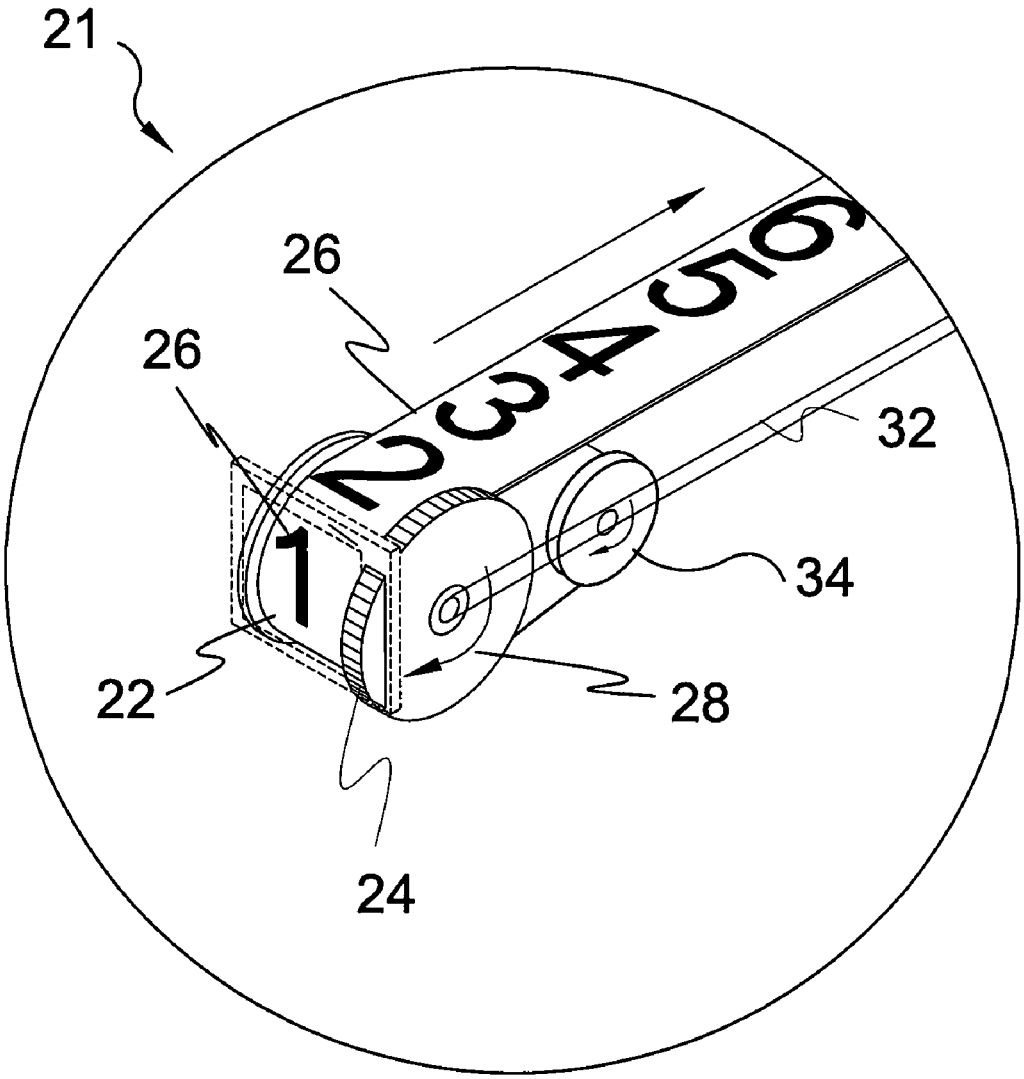
FIG. 9 is a detailed view of the present invention.

FIG. 9 is a detailed view of the dial wheel assembly 21 of the present invention. Shown is a character selection dial wheel assembly 21 of the present invention having a selection dial wheel 24 for selecting displayable indicia 18 from a plurality of characters. A drive gear 34 is in geared communication with the dial wheel 24 and its respective first spool 28 with a crossover drive belt 32 axially connected thereto on one end and axially connected to the second spool at the other end thereby enabling the user to select the desired indicia 18 displayed in the window 22 by turning the dial wheel 24 and spooling the character belt 26 between the first spool 28 and the second spool as needed.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A shoe having an integral configurable message board comprising:

a) a shoe having a sole;

b) a plurality of adjacent window members disposed in said sole of said shoe;

c) a character belt disposed within said sole associated with each said window;

d) indicia disposed on said character belt; and e) a dial wheel assembly to enable the user to selectively advance said character belt to display selected indicia in each said window for external viewing.

2. The shoe having an integral configurable message board recited in claim 1, wherein said dial wheel assembly comprises:

a) a first spool disposed proximal to said window;

b) a second spool spaced apart from said first spool; and c) a dial wheel affixed to one end of each said first spool and having a larger diameter thereof.

3. The shoe having an integral configurable message board recited in claim 2, wherein said character belt spools between said first spool and said second spool.

4. The shoe having an integral configurable message board recited in claim 3, wherein said dial wheel assembly further includes means for incrementally advancing said character belt back and forth from said first spool and said second spool.

5. The shoe having an integral configurable message board recited in claim 4, wherein said dial wheel is a gear.

6. The shoe having an integral configurable message board recited in claim 5, wherein said character belt advancement means comprises a drive gear in geared communication with said dial wheel and a drive belt in axial communication with said drive gear and said second spool thereby enabling the rotation of said drive gear to urge the rotation of said second spool in the opposing direction.

7. The shoe having an integral configurable message board recited in claim 6, wherein the rotation of said dial wheel and affixed first spool by said user results the rotation of said drive gear in the opposing direction thereby providing coordinated rotation of said first spool and said second spool in the same direction to allow for the incremental transfer of said character belt in either direction between said spools as dictated by the rotation of said dial wheel to achieve the display of selected indicia in the respective window.

8. The shoe having an integral configurable message board recited in claim 1, wherein said character belt has a plurality of differing indicia disposed thereon.

9. The shoe having an integral configurable message board recited in claim 8, wherein said indicia comprises the entire alphabet.

10. The shoe having an integral configurable message board recited in claim 8, wherein said indicia is numeric.

11. The shoe having an integral configurable message board recited in claim 8, wherein said indicia is graphic.

12. The shoe having an integral configurable message board recited in claim 8, wherein said indicia comprises any combination selected from the following group:

a) alphabetical;

b) numerical;

c) graphical; and d) blank spaces.

13. The shoe having an integral configurable message board recited in claim 12, further including an illuminable element to provide backlighting for said indicia displayed in said window.

14. The shoe having an integral configurable message board recited in claim 13, wherein said illuminable element is disposed within said first spool.

15. A method for configuring a message board display disposed in the sole of a shoe having a plurality of adjacent display windows with each window having its own respective character belt with indicia disposed on the top portion thereof and a dial wheel assembly for reciprocatively advancing said character belt between two spaced apart spools to enable the user to selectively display the differing indicia in said window comprising the steps of:

a) selecting a message to be displayed;

b) rotating a geared dial wheel and the first spool affixed thereto of a selected window;

c) rotating a drive gear that is in geared communication with said dial wheel;

d) rotating a drive belt that is in crossed communication with said drive gear and a second spool;

e) rotating said second spool;

f) advancing said character belt until the desired indicia is displayed in the selected window; and g) following the aforementioned procedure in other windows until the selected message for display is achieved.

* * * * *